US008157495B1

(12) United States Patent
Randall

(10) Patent No.: US 8,157,495 B1
(45) Date of Patent: Apr. 17, 2012

(54) APPARATUS AND METHOD FOR A PIPE HANDLER

(75) Inventor: Guy Randall, Wooster, OH (US)

(73) Assignee: Astec Industries, Inc., Chattanooga, TN (US)

( * ) Notice: Subject to any disclaimer, the term of this patent is extended or adjusted under 35 U.S.C. 154(b) by 185 days.

(21) Appl. No.: 12/011,784

(22) Filed: Jan. 30, 2008

(51) Int. Cl.
*E21B 19/00* (2006.01)
*E21B 19/15* (2006.01)

(52) U.S. Cl. ..... 414/22.55

(58) Field of Classification Search ..... 108/139–141; 248/651–654, 657, 913; 269/58, 60, 71, 269/73; 414/10–11, 22.51–22.62, 23–24, 414/589–590, 735, 744.4, 745, 745.4–745.6, 414/910, 728, 753.1, 744.6; 74/490.05, 490.06, 74/490.08, 490.09, 490.13, 490.01; 901/16
See application file for complete search history.

(56) References Cited

U.S. PATENT DOCUMENTS

| | | | | | |
|---|---|---|---|---|---|
| 2,780,376 | A | | 2/1957 | Sanders | |
| 3,522,838 | A | * | 8/1970 | Ott | 164/404 |
| 3,834,560 | A | * | 9/1974 | Miller | 414/23 |
| 3,991,887 | A | * | 11/1976 | Trout | 414/22.52 |
| 4,087,084 | A | * | 5/1978 | Meyers | 266/287 |
| 4,233,119 | A | * | 11/1980 | Meyers et al. | 202/241 |
| 4,362,435 | A | * | 12/1982 | Henry | 405/184.5 |
| 4,684,314 | A | * | 8/1987 | Luth | 414/746.1 |
| 4,834,195 | A | | 5/1989 | Robinson | |
| 4,948,329 | A | * | 8/1990 | Fuse et al. | 414/735 |
| 5,183,366 | A | * | 2/1993 | Paech | 414/22.52 |
| 5,243,872 | A | * | 9/1993 | Yang et al. | 74/479.01 |
| 5,607,280 | A | | 3/1997 | Rozendaal | |
| 5,791,822 | A | | 8/1998 | Edmondson et al. | |
| 5,865,063 | A | * | 2/1999 | Sheldon | 74/490.01 |
| 5,921,533 | A | * | 7/1999 | Miyamoto et al. | 269/71 |
| 6,074,153 | A | | 6/2000 | Allen | |
| 6,085,852 | A | | 7/2000 | Sparks et al. | |
| 6,179,065 | B1 | | 1/2001 | Payne et al. | |
| 6,220,807 | B1 | * | 4/2001 | Sorokan | 414/22.62 |
| 6,237,703 | B1 | | 5/2001 | Draney et al. | |
| 6,283,702 | B1 | | 9/2001 | Devlugt et al. | |
| 6,332,502 | B1 | | 12/2001 | Mills et al. | |
| 6,360,830 | B1 | | 3/2002 | Price | |
| 6,374,927 | B1 | | 4/2002 | Guterman et al. | |

(Continued)

FOREIGN PATENT DOCUMENTS

GB 2264736 A * 9/1993

(Continued)

*Primary Examiner* — Gregory Adams
(74) *Attorney, Agent, or Firm* — Chambliss, Bahner & Stophel, P.C.

(57) ABSTRACT

A pipe handler comprising a skid and a base having a base longitudinal axis. The base is adjustably mounted on the skid. The pipe handler comprises a means for adjusting the base, a boom, and a means for moving the boom between a position substantially parallel to the base longitudinal axis and a position substantially perpendicular to the base longitudinal axis. The pipe handler includes a pipe gripper that is pivotally attached to the boom. The base of the pipe handler is adapted to be adjusted in any direction relative to the skid when the boom is in any position from substantially parallel to the base longitudinal axis to substantially perpendicular to the base longitudinal axis. The method also includes engaging a pipe with a pipe gripper, moving the boom in a direction toward a pipe rotation mechanism, adjusting the base, and releasing the pipe from the pipe gripper.

18 Claims, 7 Drawing Sheets

U.S. PATENT DOCUMENTS 6,374,928 B1 4/2002 Teller et al.
6,390,762 B1 * 5/2002 Peery et al. ..... 414/589
6,408,954 B1 6/2002 Price et al.
6,474,931 B1 11/2002 Austin et al.
6,533,046 B2 3/2003 Mills et al.
6,543,551 B1 4/2003 Sparks et al.
6,550,547 B1 4/2003 Payne et al.
6,702,043 B2 3/2004 Koch et al.
6,814,164 B2 11/2004 Mills et al.
2002/0079137 A1 6/2002 Mills et al.
2002/0153169 A1 10/2002 Sewell
2004/0007388 A1 1/2004 Mills et al.
2004/0022605 A1 2/2004 Anthis et al.
2004/0129455 A1 7/2004 Koch et al.
2006/0045654 A1 * 3/2006 Guidroz ..... 414/22.61

FOREIGN PATENT DOCUMENTS

WO WO 2006038790 A1 * 4/2006

* cited by examiner

APPARATUS AND METHOD FOR A PIPE HANDLER

FIELD OF THE INVENTION

The present invention relates generally to drilling equipment, and particularly to pipe handlers used in connection with drilling operations.

BACKGROUND AND DESCRIPTION OF THE PRIOR ART

To enhance drilling productivity, it is important to maximize the efficiency with which pipe sections can be loaded into and unloaded from a magazine. Until fairly recently, pipe sections were manually carried between the magazine and the pipe rotation mechanism of a drilling machine, and were also manually loaded into and unloaded from the magazine. Recent developments, however, have improved pipe loading and unloading efficiencies, primarily through automation. Still, misalignment between pipe sections and pipe rotation mechanisms resulting from settling or damaged drilling assemblies and pipe handlers requires adjustment of the alignment between pipe sections and pipe rotation mechanisms.

It is known to provide various assemblies and mechanisms for moving a pipe section between a magazine and a pipe rotation mechanism. More particularly, it is known to handle drill pipe using a device that is generally similar to a human forearm, elbow, wrist, and hand. With the arm down in the horizontal position, the gripper is rolled to receive a pipe from the side. The grippers grasp the pipe and roll 90 degrees about a horizontal axis to hold the pipe upward, yet still horizontal. Then the arm swings upward about a perpendicular horizontal axis to elevate the pipe to the vertical position and in alignment with the rotary spindle of the drilling rig. In these conventional assemblies, the alignment of the drill pipe to the pipe rotation mechanism almost always requires manual human contact with the pipe in order to push the pipe into final alignment so as to prevent cross-threading. This exposes humans to a dangerous environment where risk of injury is statistically very high. It also increases labor costs and reduces productivity of the drilling operation.

It is also known to use slotted parts, shims or rewelded parts for adjusting the alignment between a drill pipe and the spindle or quill of a pipe rotation mechanism on a drilling assembly. The conventional pipe handlers also suffer from one or more disadvantages. For example, the use of slotted parts, shims or rewelded parts requires very heavy and awkward components to be held precisely during retightening or reassembly. Further, the adjustments can only be made when the pipe handler arm is down. As a result, alignment cannot be checked after the adjustment is made until the handler arm is raised again. The adjustment of the alignment of conventional pipe handlers using slotted parts, shims or rewelded parts is also time consuming. Moreover, conventional pipe handlers using slotted parts, shims or rewelded parts to make adjustments to the alignment between the drill pipe and the pipe rotation mechanism cannot accommodate all possible combinations of misalignment so precise alignment is not possible in certain circumstances.

It would be desirable, therefore, if an apparatus and method for a pipe handler could be provided that would reduce the risk of injury to humans in connection with adjusting the alignment of a drill pipe to a pipe rotation mechanism. It would also be desirable if such an apparatus and method for a pipe handler could be provided that would reduce the amount of time and labor required to adjust the alignment between a drill pipe and the pipe rotation mechanism and increase the productivity of drilling operations. It would be further desirable if such an apparatus and method for a pipe handler could be provided that would permit adjustment of the alignment of a drill pipe to the pipe rotation mechanism while the pipe is held in alignment with the pipe rotation mechanism. It would be still further desirable if such an apparatus and method for a pipe handler could be provided that would permit the precise and infinite adjustment of the alignment between a drill pipe and the pipe rotation mechanism. It would also be desirable if such an apparatus and method for a pipe handler could be provided that would permit the adjustment of the alignment between a drill pipe and the pipe rotation mechanism when the drilling assembly or pipe handler settle or is damaged.

ADVANTAGES OF THE PREFERRED EMBODIMENTS OF THE INVENTION

Accordingly, it is an advantage of the preferred embodiments of the invention claimed herein to provide an apparatus and method for a pipe handler that would reduce the risk of injury to humans in connection with the adjustment of the alignment between a drill pipe and a pipe rotation mechanism. It is also an advantage of the preferred embodiments of the invention claimed herein to provide an apparatus and method for a pipe handler that would reduce the amount of time and labor required to adjust the alignment between a drill pipe and a pipe rotation mechanism and increase the productivity of drilling operations. It is a further advantage of the preferred embodiments of the invention claimed herein to provide an apparatus and method for a pipe handler that would permit adjustment of the alignment between a drill pipe and a pipe rotation mechanism while the pipe is held in alignment with the pipe rotation mechanism. It is a still further advantage of the preferred embodiments of the invention claimed herein to provide an apparatus and method for a pipe handler that would permit the precise and infinite adjustment of the alignment between a drill pipe and a pipe rotation mechanism. It is also an advantage of the preferred embodiments of the invention claimed herein to provide an apparatus and method for a pipe handler that permits the adjustment of the alignment between a drill pipe and the pipe rotation mechanism when the drilling assembly or the pipe handler settles or is damaged.

Additional advantages of the preferred embodiments of the invention will become apparent from an examination of the drawings and the ensuing description.

SUMMARY OF THE INVENTION

The invention comprises a pipe handler comprising a skid and a base having a base longitudinal axis. The base is adjustably mounted on the skid. The pipe handler also comprises a means for adjusting the base and a boom having a boom longitudinal axis. The boom is pivotally attached to the base. The pipe handler also includes a means for moving the boom between a position substantially parallel to the base longitudinal axis and a position substantially perpendicular to the base longitudinal axis. The pipe handler also includes a pipe gripper that is pivotally attached to the boom. The base of the pipe handler is adapted to be adjusted in any direction relative to the skid when the boom is in any position from substantially parallel to the base longitudinal axis to substantially perpendicular to the base longitudinal axis.

The invention also comprises a method for handling pipe. The method for handling pipe comprises providing a pipe handler comprising a skid and a base having a base longitudinal axis. The base is adjustably mounted on the skid. The pipe handler also comprises a means for adjusting the base and a boom having a boom longitudinal axis. The boom is pivotally attached to the base. The pipe handler also includes a means for moving the boom between a position substantially parallel to the base longitudinal axis and a position substantially perpendicular to the base longitudinal axis. The pipe handler also includes a pipe gripper that is pivotally attached to the boom. The base of the pipe handler is adapted to be adjusted in any direction relative to the skid when the boom is in any position from substantially parallel to the base longitudinal axis to substantially perpendicular to the base longitudinal axis. The method also includes engaging a pipe with a pipe gripper, moving the boom in a direction toward a pipe rotation mechanism, adjusting the base, and releasing the pipe from the pipe gripper.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
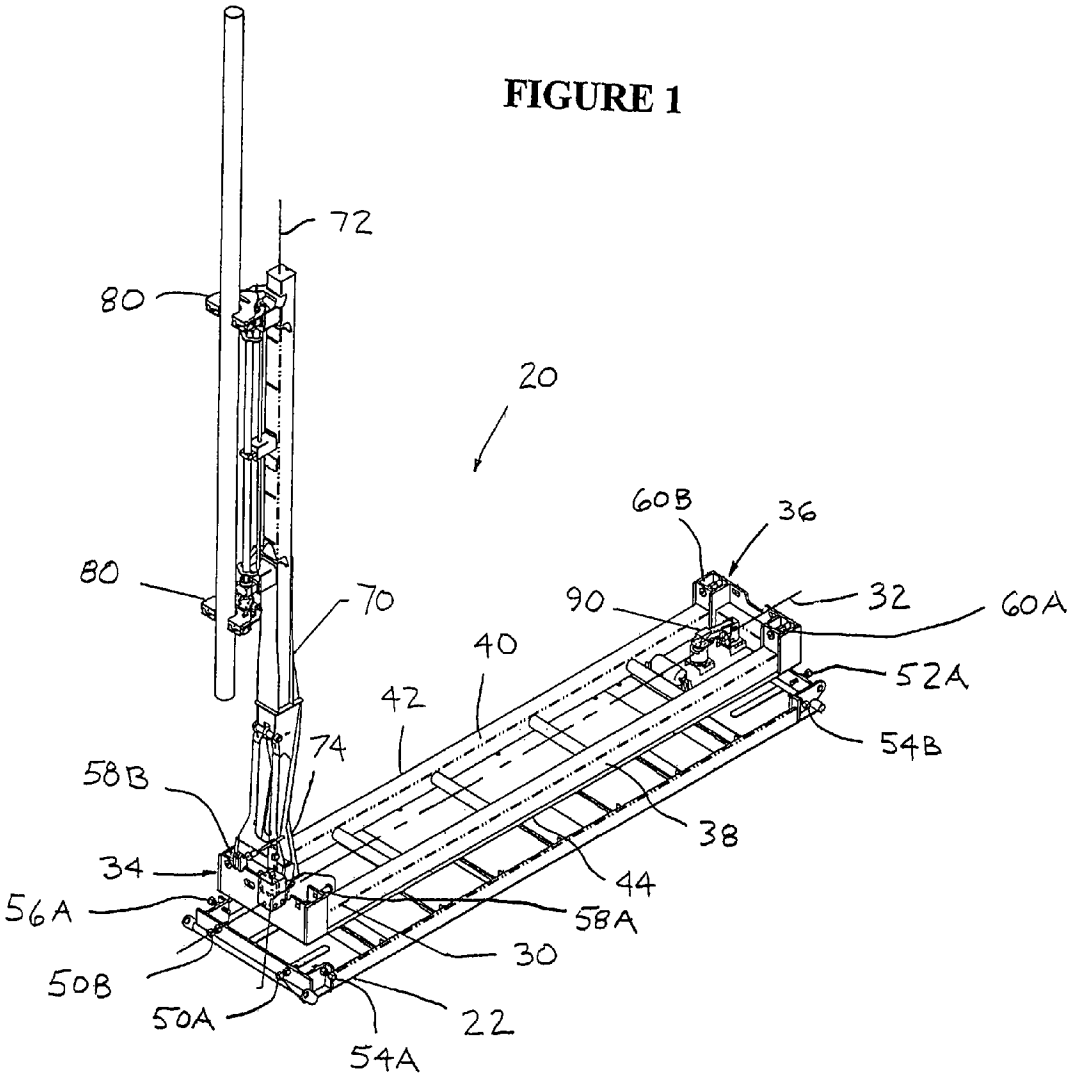
FIG. 1 is an exploded perspective view of the preferred embodiment of the pipe handler in accordance with the present invention.

Referring now to the drawings, the preferred embodiments of the apparatus and method for a pipe handler are illustrated by FIGS. 1 through 8. As shown in FIGS. 1 through 8 and described in detail below, the preferred embodiments of the invention provide an apparatus and method for precisely adjusting a pipe handler in any possible direction so as to correct any possible misalignment between a pipe and a pipe rotation mechanism such as the type commonly used in connection with pipe drilling assemblies. Further, the preferred embodiments of the invention provide an apparatus and method for a pipe handler that may be adjusted when the boom has moved a pipe in close proximity to such a pipe rotation mechanism so that adjustments may be visually observed as they are being made. As a result, the preferred embodiments of the invention provide an apparatus and method for a pipe handler that achieves improved alignment between a pipe and a pipe rotation mechanism.

Referring now to FIG. 1, an exploded perspective view of the preferred embodiment of the pipe handler in accordance with the present invention is illustrated. As shown in FIG. 1, the preferred pipe handler is designated generally by reference numeral 20. More particularly, preferred pipe handler 20 includes skid 22. The preferred skid 22 is adapted to contact a support surface beneath it. The preferred skid 22 is also not connected to any other item of equipment such as a drilling assembly. While FIG. 1 illustrates the preferred configuration and arrangement of the skid, it is contemplated within the scope of the invention that the skid may be of any suitable configuration and arrangement. It is also contemplated within the scope of the invention that the skid may be connected to another item of equipment.

Still referring to FIG. 1, the preferred pipe handler 20 also includes base 30. The preferred base 30 includes base longitudinal axis 32, forward end 34, rearward end 36, left side 38, right side 40, base top 42 and base bottom 44. The preferred base 30 is adjustably mounted on skid 22 and adapted to be moved relative to the skid. More particularly, the preferred base 30 is adapted to be moved in any direction relative to skid 22. In addition, the preferred base 30 is adapted to be moved in any direction relative to skid 22 regardless of the position of the boom, as described in more detail below. While FIG. 1 illustrates the preferred configuration and arrangement of the base, it is contemplated within the scope of the invention that the base may be of any suitable configuration and arrangement.

Still referring to FIG. 1, the preferred pipe handler 20 also includes a means for adjusting base 30. See also FIG. 3. The preferred means for adjusting base 30 includes a pair of forward end jack screws 50A and 50B and a pair of rearward end jack screws 52A and 52B (see FIG. 7). The preferred pair of forward end jack screws 50A and 50B and the preferred pair of rearward end jack screws 52A and 52B are adapted to selectively move base 30 in a direction toward forward end 34 of the base or in a direction toward rearward end 36 of the base. While FIG. 1 illustrates the preferred configuration and arrangement of the means for selectively moving the base in a direction toward the forward end of the base or in a direction toward the rearward end of the base, it is contemplated within the scope of the invention that the means for adjusting the base may include any suitable device, mechanism, assembly or combination thereof. It is also contemplated within the scope of the invention that more or fewer than two forward end jack screws and more or fewer than two rearward end jack screws may be used to selectively move the base in a direction toward the forward end of the base or in a direction toward the rearward end of the base.

Figure 7:
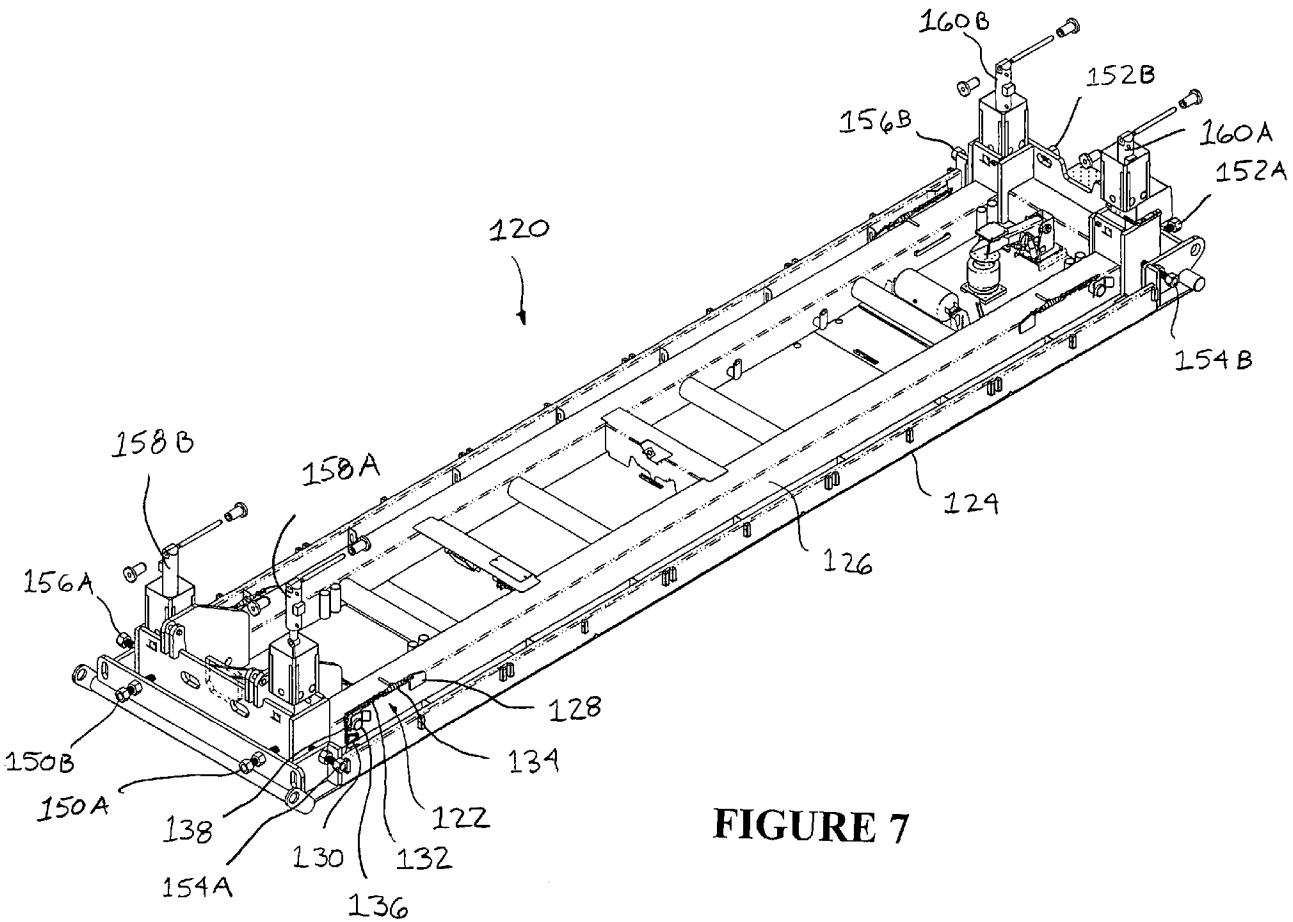
FIG. 7 is an exploded perspective view of an alternative embodiment of the skid, base and means for adjusting the base of the pipe handler in accordance with the present invention.

Referring still to FIG. 1, the preferred means for adjusting base 30 also includes a pair of left side jack screws 54A and 54B and a pair of right side jack screws 56A and 56B (see FIG. 7). The preferred pair of left side jack screws 54A and 54B and the preferred pair of right side jack screws 56A and 56B are adapted to selectively move base 30 in a direction toward left side 38 of the base or in a direction toward right side 40 of the base. The preferred pair of forward end jack screws 50A and 50B, the preferred pair of rearward end jack screws 52A and 52B, the preferred pair of left side jack screws 54A and 54B and the preferred pair of right side jack screws 56A and 56B are adapted to rotatably move base 30 about an axis substantially normal to base longitudinal axis 32. While FIG. 1 illustrates the preferred configuration and arrangement of the means for selectively moving the base in a direction toward the left side of the base or in a direction toward the right side of the base, it is contemplated within the scope of the invention that the means for adjusting the base may include any suitable device, mechanism, assembly or combination thereof. It is also contemplated within the scope of the invention that more or fewer than two left side jack screws and more or fewer than two right side jack screws may be used to selectively move the base in a direction toward the left side of the base or in a direction toward the right side of the base.

Still referring to FIG. 1, the preferred means for adjusting base 30 further includes a pair of forward end jack cylinders 58A and 58B, and a pair of rearward end jack cylinders 60A and 60B. See also FIGS. 3 and 7. The preferred pair of forward end jack cylinders 58A and 58B and the preferred pair of rearward end jack cylinders 60A and 60B are adapted to selectively move base 30 in a direction toward base top 42 or in a direction toward base bottom 44. The preferred pair of forward end jack cylinders 58A and 58B and the preferred pair of rearward end jack cylinders 60A and 60B are adapted to rotatably move base 30 about an axis substantially parallel to base longitudinal axis 32. The preferred pair of forward end jack cylinders 58A and 58B and the preferred pair of rearward end jack cylinders 60A and 60B are also adapted to rotatably move base 30 about an axis substantially perpendicular to base longitudinal axis 32 in a horizontal plane. While FIG. 1 illustrates the preferred configuration and arrangement of the means for selectively moving the base in a direction toward the base top or in a direction toward the base bottom, it is contemplated within the scope of the invention that the means for adjusting the base may include any suitable device, mechanism, assembly or combination thereof. It is also contemplated within the scope of the invention that more or fewer than two forward end jack cylinders and more or fewer than two rearward end jack cylinders may be used to selectively move the base in a direction toward the base top or in a direction toward the base bottom.

Still referring to FIG. 1, the preferred pipe handler 20 also includes boom 70. The preferred boom 70 has boom longitudinal axis 72 and is pivotally attached to base 30. The preferred boom 70 is adapted to be moved by a means for moving the boom such as boom cylinder 74. The preferred boom cylinder 74 is adapted to move boom 70 between a position substantially parallel to base longitudinal axis 32 and a position substantially perpendicular to the base longitudinal axis. While FIG. 1 illustrates the preferred configuration and arrangement of the boom and the means for moving the boom, it is contemplated that the boom and the means for moving the boom may be of any suitable configuration and arrangement. It is also contemplated that the boom may be attached to the base by any suitable device, mechanism, assembly or combination thereof including without limitation links, pins, slots, channels, grooves and the like. It is further contemplated that the means for moving the boom may be any suitable device, mechanism, assembly or combination thereof including without limitation hydraulic and pneumatic actuators and the like.

Referring still to FIG. 1, the preferred pipe handler 20 also includes a plurality of pipe grippers 80. Each of the preferred pipe grippers 80 is pivotally attached to boom 30. Preferably, each of the pipe grippers 80 is adapted to pivot approximately 90° in either direction about an axis that is substantially parallel to boom longitudinal axis 32. The preferred pipe grippers 80 are adapted to releasably engage a pipe and facilitate the alignment between the pipe and a pipe rotation mechanism such as those commonly found on a drilling assembly. While FIG. 1 illustrates the preferred arrangement and configuration of the pipe grippers, it is contemplated within the scope of the invention that the pipe grippers may be of any suitable configuration and arrangement. It is also contemplated within the scope of the invention that more or fewer than two pipe grippers may be provided on the pipe handler.

Still referring to FIG. 1, the preferred pipe handler 20 also includes dampener 90. The preferred dampener is adapted to dampen the force applied by boom 70 when it is moved into a position that is substantially parallel to base longitudinal axis 32. While FIG. 1 illustrates the preferred configuration and arrangement of the dampener, it is contemplated within the scope of the invention that the any the dampener may be of any suitable configuration and arrangement.

Figure 2:
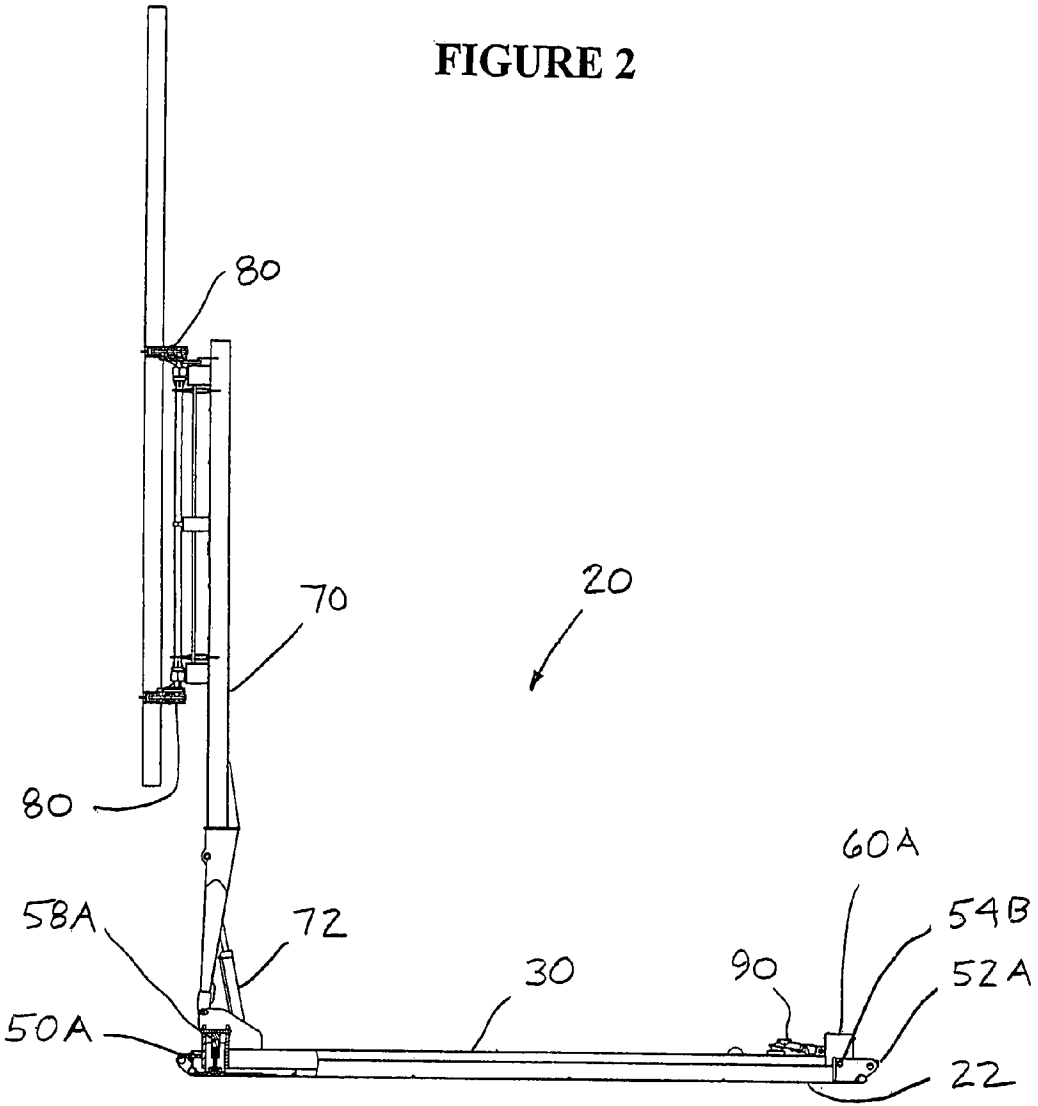
FIG. 2 is a partial sectional front view of the preferred embodiment of the pipe handler illustrated in FIGS. 1 and 1A.

Referring now to FIG. 2, a partial sectional front view of preferred pipe handler 20 is illustrated. As shown in FIG. 2, the preferred pipe handler 20 includes skid 22, base 30, forward end jack screw 50A, rearward end jack screw 52A, left side jack cylinder 54A, forward end jack cylinder 58A, rearward end jack cylinder 60A, boom 70, boom cylinder 74, pipe grippers 80 and dampener 90.

Figure 3:
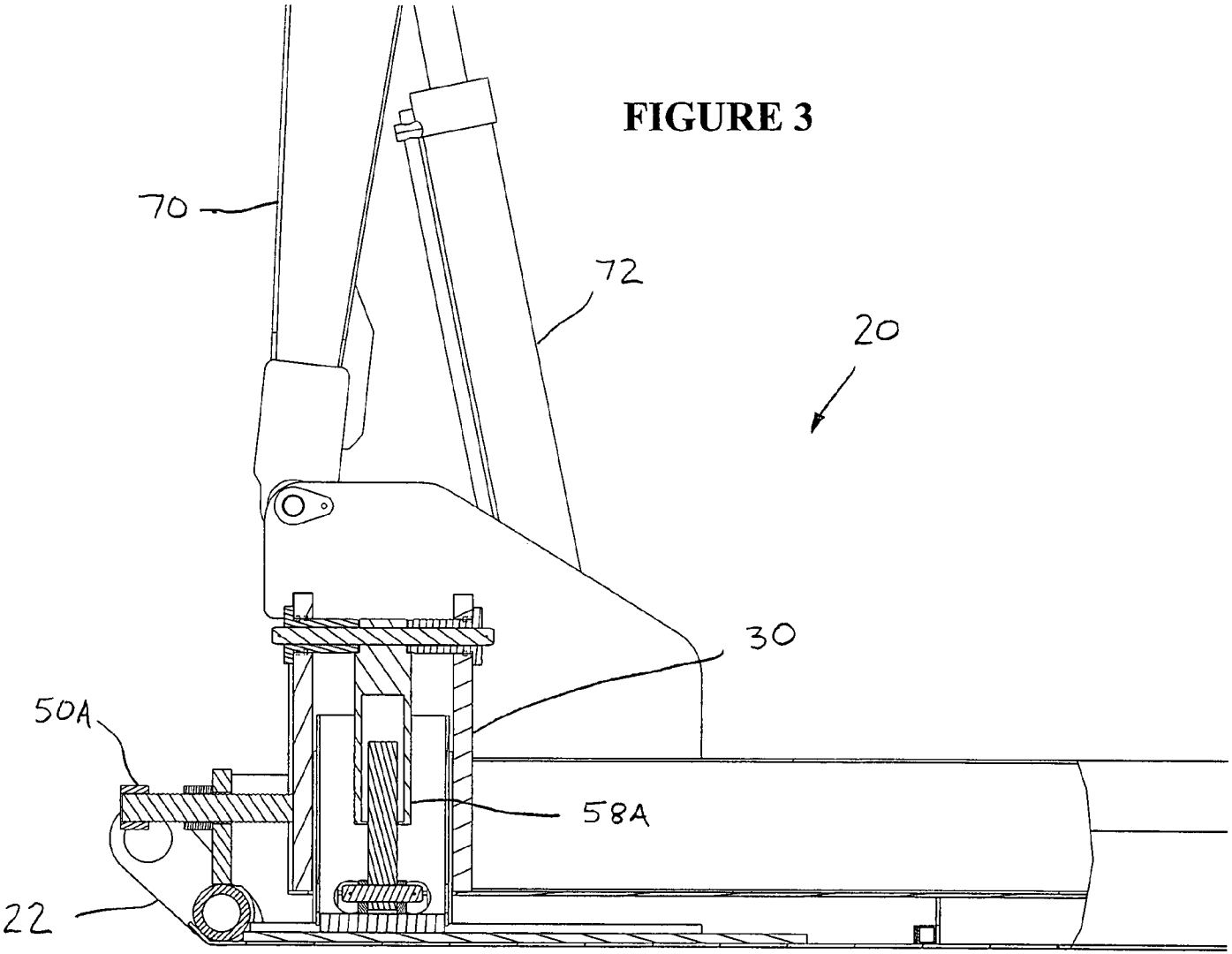
FIG. 3 is a partial sectional view of the preferred embodiment of the means for adjusting the pipe handler illustrated in FIGS. 1 and 2.

Referring now to FIG. 3, a partial sectional view of the preferred means for adjusting the pipe handler 20 is illustrated. As shown in FIG. 3, the preferred pipe handler 20 includes skid 22, base 30, forward end jack screw 50A, forward end jack cylinder 58A, boom 70 and boom cylinder 72. More particularly, the preferred forward end jack screw 50A threadingly engages skid 22 and is adapted to contact base 30. When the preferred forward end jack screw 50A is tightened or rotated clockwise, it is adapted to apply force to the base in a direction toward the rearward end of the base. When the preferred forward end jack screw 50A is loosened or rotated counter-clockwise, it is adapted to allow the base to move in a direction toward the forward end of the base. The preferred forward end jack cylinder 58A is disposed between the skid and the base. When the preferred forward end jack cylinder 58A extends, the base moves in a direction toward the base top. When the preferred forward end jack cylinder 58A retracts, the base moves in a direction toward the base bottom. While FIG. 3 illustrates the preferred arrangement and configuration of the means for adjusting the base, it is contemplated within the scope of the invention that jack screws and cylinders may be interchangeably used and that only jack screws or only cylinders may be used. It is also contemplated within the scope of the invention that any other suitable devices, mechanisms, assemblies or combinations thereof may be used to move the base relative to the skid including without limitation hydraulic and pneumatic actuators.

Figures 4, 5:
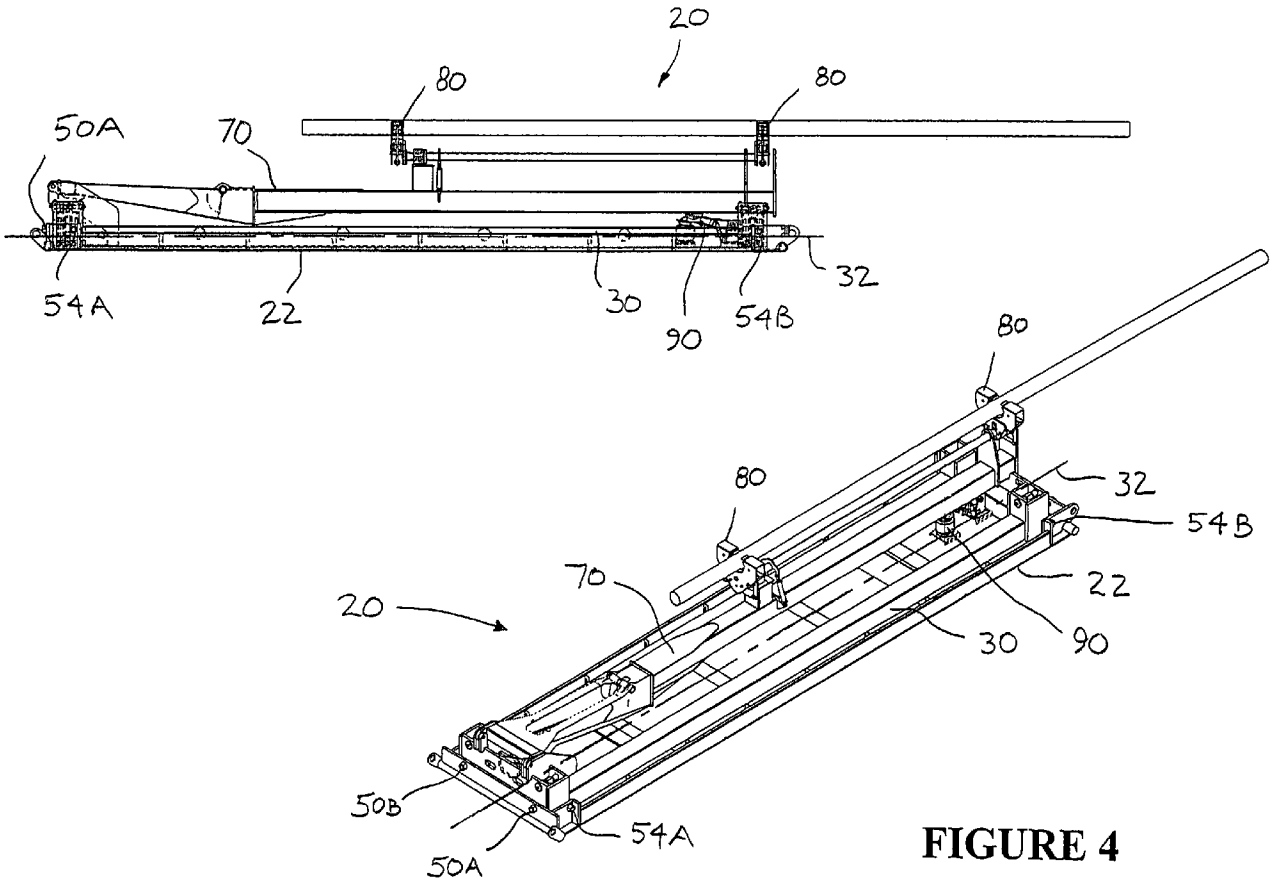
FIG. 4 is a perspective view of the preferred embodiment of the pipe handler illustrated in FIGS. 1 through 3 showing the boom in a position that is substantially parallel to the base longitudinal axis.
FIG. 5 is a front view of the preferred embodiment of the pipe handler illustrated in FIGS. 1 through 4 showing the boom in a position that is substantially parallel to the base longitudinal axis.

Referring now to FIG. 4, a perspective view of the preferred pipe handler 20 is illustrated. More particularly, FIG. 4 illustrates preferred pipe handler 20 with boom 70 in a position that is substantially parallel to base longitudinal axis 32. As shown in FIG. 4, the preferred pipe handler 20 includes skid 22, base 30, forward end jack screws 50A and 50B, left side jack screws 54A and 54B, boom 70, pipe grippers 80 and dampener 90. While FIG. 4 illustrates the boom in a position that is substantially parallel to the base longitudinal axis, it is contemplated within the scope of the invention that the boom may be moved into any angular disposition relative to the base, including without limitation positions that are greater than 90° from the position shown in FIG. 4.

Referring now to FIG. 5, a front view of the preferred pipe handler 20 is illustrated. Like FIG. 4, FIG. 5 also illustrates preferred pipe handler 20 with boom 70 in a position that is substantially parallel to base longitudinal axis 32. As shown in FIG. 5, preferred pipe handler 20 includes skid 22, base 30, forward end jack screw 50A, left side jack screws 54A and 54B, boom 70, pipe grippers 80 and dampener 90.

Figure 6A:
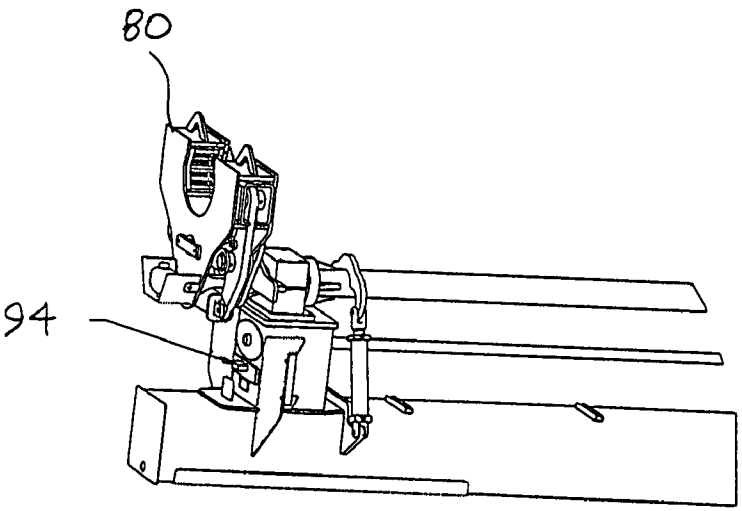
FIG. 6A is a perspective view of the preferred pipe gripper of the pipe handler illustrated in FIGS. 1 through 6.
Figure 6:
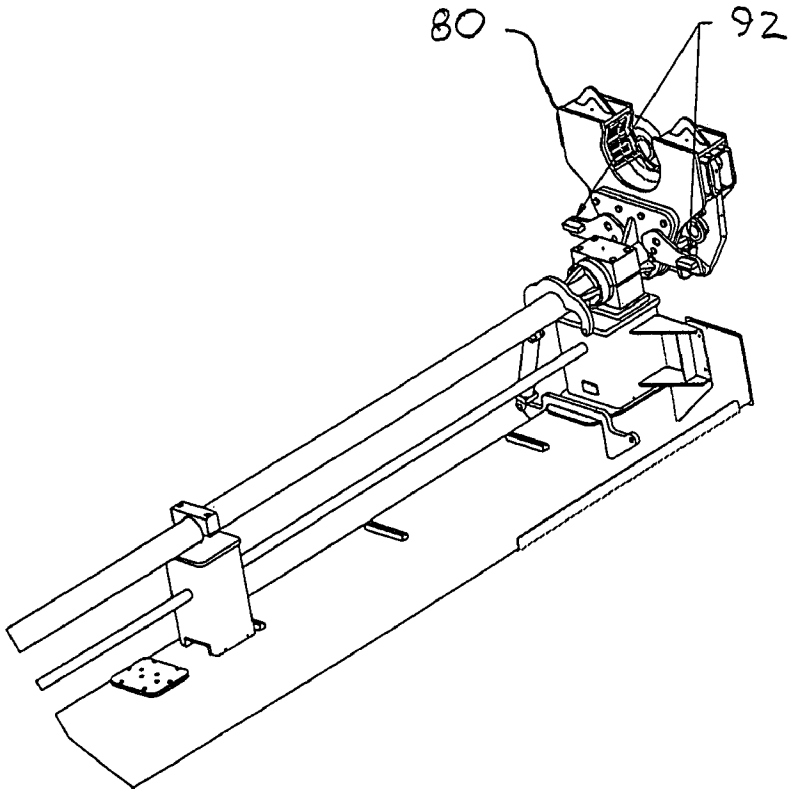
FIG. 6 is a perspective view of the preferred pipe gripper of the pipe handler illustrated in FIGS. 1 through 5.

Referring now to FIGS. 6 and 6A, perspective views of preferred pipe gripper 80 of pipe handler 20 are illustrated. As shown in FIG. 6, the preferred pipe gripper 80 includes a pair of stop arms 92 extending radially from the axis about which the pipe gripper rotates. As shown in FIG. 6A, the preferred boom 70 includes stop block 94 which is adapted to contact stop arms 92 when the pipe gripper rotates approximately 92° in either direction. Preferably, the arrangement of the stop arms and the stop block prevent the pipe gripper from over-rotation in either direction. While FIGS. 6 and 6A illustrate the preferred configuration and arrangement of the stop arms and stop block, it is contemplated within the scope of the invention that the stop arms and the stop block may be of any suitable configuration and arrangement.

Referring now to FIG. 7, a perspective view of an alternative embodiment of pipe handler in accordance with the present invention is illustrated. As shown in FIG. 7, the alternative embodiment of the pipe handler is designated generally by reference numeral 120. The preferred pipe handler 120 includes anchoring system 122. The preferred anchoring system 122 extends between skid 124 and base 126 and is adapted to stabilize and anchor the base on the skid. The preferred anchoring system 122 includes base anchor plate 128 which is mounted to base 126 and skid anchor plate 130 (see also FIG. 8) which is mounted to skid 124. Preferably, chain 132 and a chain tightening device such as ratchet 134 extend between base anchor plate 128 and skid anchor plate 130. The preferred chain tightening device is adapted to releasably apply force to chain 132 so as to tighten the chain and stabilize and anchor the base to the skid. The preferred chain 132 extends partially around pipe 136 and angle bracket 138 (see also FIG. 8) prevents the chain from sliding off the pipe. Preferably, anchoring system 122 is provided on each of the four corners of the base and skid. While FIG. 7 illustrates the preferred arrangement and configuration of the anchoring system, it is contemplated that the anchoring system may be of any suitable arrangement and configuration. It is also contemplated within the scope of the invention that the chain tightening device may be any suitable device, mechanism, assembly or combination thereof adapted to releasably apply linear force to a chain, cable, rope and the like.

Still referring to FIG. 7, the preferred means for adjusting the base includes eight jack screws 150A, 150B, 152A, 152B, 154A, 154B, 156A and 156B and four jack cylinders 158A, 158B, 160A and 160B arranged around the four corners of base 126 and skid 124. More particularly, each corner of base 126 and skid 124 is provided with a pair of jack screws and a single jack cylinder. As a result of the arrangement of jack screws and jack cylinders, the base may be moved in any linear or angular direction relative to the skid. While FIG. 7 illustrates the preferred arrangement of jack screws and jack cylinders, it is contemplated within the scope of the invention that the jack screws and the jack cylinder may be of any suitable arrangement.

Figure 8:
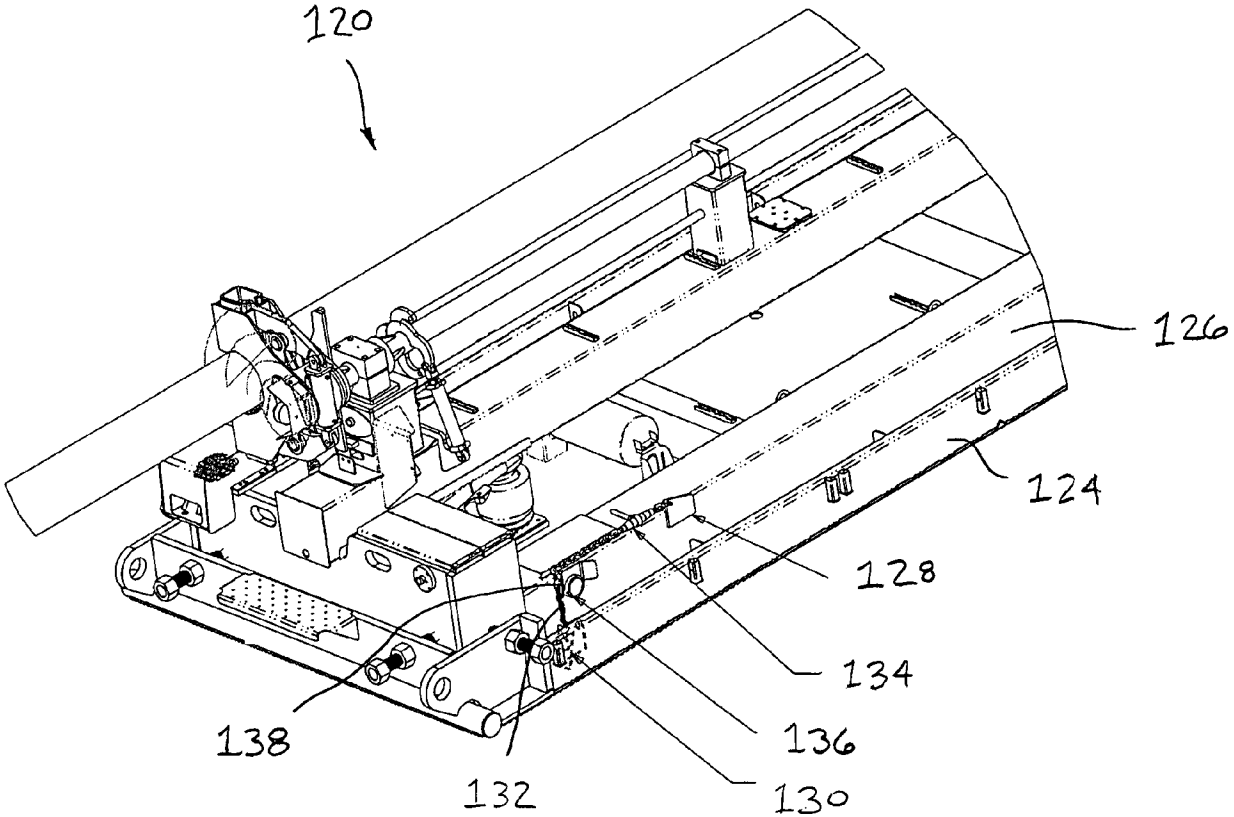
FIG. 8 is a perspective view of the alternative embodiment of the pipe handler illustrated in FIG. 7.

Referring now to FIG. 8, a perspective view of preferred pipe handler 120 is illustrated. As shown in FIG. 8, the preferred anchoring system 122 includes base anchor plate 128, skid anchor plate 130, chain 132 and ratchet 134, pipe 136 and angle bracket 138.

The invention also comprises a method for handling pipe. The preferred method for handling pipe includes a pipe handler as described above. More particularly, the preferred pipe handler includes a skid, a base having a base longitudinal axis and being adjustably mounted on the skid, a means for adjusting the base, a boom having a boom longitudinal axis and being pivotally attached to the base, a means for moving the boom between a position substantially parallel to the base longitudinal axis and a position substantially perpendicular to the base longitudinal axis, and a pipe gripper that is pivotally attached to the boom. Preferably, the base is adapted to be adjusted in any direction relative to the skid when the boom is in any position from substantially parallel to the base longitudinal axis to substantially perpendicular to the base longitudinal axis. The method further includes engaging a pipe with the pipe gripper, moving the boom in a direction toward a pipe rotation mechanism, adjusting the base, and releasing the pipe from the pipe gripper.

In operation, several advantages of the invention are achieved. For example, the preferred embodiments of the invention described and claimed herein provide an apparatus and method for a pipe handler that reduces the risk of injury to humans in connection with the adjustment of the alignment between a drill pipe and a pipe rotation mechanism. The preferred embodiments of the invention described and claimed herein provide an apparatus and method for a pipe handler that reduces the amount of time and labor required to adjust the alignment between a drill pipe and a pipe rotation mechanism and increases the productivity of drilling operations. The preferred embodiments of the invention described and claimed herein provide an apparatus and method for a pipe handler that permits adjustment of the alignment between a drill pipe and a pipe rotation mechanism while the pipe is held in alignment with the pipe rotation mechanism. The preferred embodiments of the invention described and claimed herein provide an apparatus and method for a pipe handler that permits the precise and infinite adjustment of the alignment between a drill pipe and a pipe rotation mechanism.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A pipe handler comprising:

(a) a skid;

(b) a base, said base having a forward end, a rearward end, and a base longitudinal axis and being adjustably mounted on the skid;

(c) a means for adjusting the base, said means for adjusting the base including at least eight actuators, said at least eight actuators including a plurality of jack screws, and said plurality of jack screws including a forward end jack screw and a rearward end jack screw, said forward end jack screw and said rearward end jack screw being adapted to selectively move the base in a direction toward the forward end of the base or in a direction toward the rearward end of the base;

(d) a boom, said boom having a boom longitudinal axis and being pivotally attached to the base;

(e) a means for moving the boom, said means for moving the boom being adapted to move the boom between a position substantially parallel to the base longitudinal axis and a position substantially perpendicular to the base longitudinal axis;

(f) a pipe gripper, said pipe gripper being pivotally attached to the boom;

wherein the base is adapted to be adjusted in all directions relative to the skid when the boom is in any position from substantially parallel to the base longitudinal axis to substantially perpendicular to the base longitudinal axis and the assembly is adapted to provide precise and infinite adjustment of the alignment of a drill pipe.

2. The pipe handler of claim 1 wherein the base comprises a left side and a right side, and the plurality of jack screws comprises a left side jack screw and a right side jack screw, said left side jack screw and said right side jack screw being adapted to selectively move the base in a direction toward the left side of the base or in a direction toward the right side of the base.

3. The pipe handler of claim 1 wherein the plurality of jack screws are adapted to rotatably move the base about an axis substantially normal to the base longitudinal axis.

4. The pipe handler of claim 1 wherein the means for adjusting the base includes a plurality of jack cylinders.

5. The pipe handler of claim 4 wherein the base comprises a base top and a base bottom, and the plurality of jack cylinders are adapted to selectively move the base in a direction toward the base top or in a direction toward the base bottom.

6. The pipe handler of claim 4 wherein the plurality of jack cylinders are adapted to rotatably move the base about an axis substantially parallel to the base longitudinal axis.

7. The pipe handler of claim 1 wherein the means for moving the boom includes a boom cylinder.

8. The pipe handler of claim 1 wherein the pipe gripper is adapted to pivot approximately 90° about an axis that is substantially parallel to the boom longitudinal axis.

9. The pipe handler of claim 1 further comprising an anchoring system extending between the skid and the base.

10. A pipe handler comprising:

(a) a skid;

(b) a base, said base being adjustably mounted on the skid and having a base longitudinal axis, a forward end, a rearward end, a left side, a right side, a base top and a base bottom;

(c) a pair of forward end jack screws, a pair of rearward end jack screws, a pair of left side jack screws and a pair of right side jack screws;

(d) a pair of forward end jack cylinders and a pair of rearward end jack cylinders;

(e) a boom, said boom having a boom longitudinal axis and being pivotally attached to the base;

(f) a boom cylinder, said boom cylinder being adapted to move the boom between a position substantially parallel to the base longitudinal axis and a position substantially perpendicular to the base longitudinal axis;

(g) a plurality of pipe grippers, each of said plurality of pipe grippers being pivotally attached to the boom;

wherein the base is adapted to be adjusted in any direction relative to the skid when the boom is in any position from substantially parallel to the base longitudinal axis to substantially perpendicular to the base longitudinal axis and the assembly is adapted to provide an accurate and repeatable alignment of a drill pipe.

11. The pipe handler of claim 10 wherein the pair of forward end jack screws and the pair of rearward end jack screws are adapted to selectively move the base in a direction toward the forward end of the base or in a direction toward the rearward end of the base.

12. The pipe handler of claim 10 wherein the pair of left side jack screws and the pair of right side jack screws are adapted to selectively move the base in a direction toward the left side of the base or in a direction toward the right side of the base.

13. The pipe handler of claim 10 wherein the pair of forward end jack screws, the pair of rearward end jack screws, the pair of left side jack screws and the pair of right side jack screws are adapted to rotatably move the base about an axis substantially normal to the base longitudinal axis.

14. The pipe handler of claim 10 wherein the pair of forward end jack cylinders and the pair of rearward end jack cylinders are adapted to selectively move the base in a direction toward the base top or in a direction toward the base bottom.

15. The pipe handler of claim 10 wherein the pair of forward end jack cylinders and the pair of rearward end jack cylinders are adapted to rotatably move the base about an axis substantially parallel to the base longitudinal axis.

16. The pipe handler of claim 10 wherein the pipe gripper is adapted to pivot approximately 90° about an axis that is substantially parallel to the boom longitudinal axis.

17. The pipe handler of claim 10 further comprising an anchoring system extending between the skid and the base.

18. A method for handling pipe comprising:

(a) providing a pipe handler comprising:

(1) a skid;

(2) a base, said base having a forward end and a rearward end, and a base longitudinal axis being adjustably mounted on the skid;

(3) a means for adjusting the base, said means for adjusting the base including at least eight actuators, said at least eight actuators including a plurality of jack screws, and said plurality of jack screws including a forward end jack screw and a rearward end jack screw, said forward end jack screw and said rearward end jack screw being adapted to selectively move the base in a direction toward the forward end of the base or in a direction toward the rearward end of the base;

(4) a boom, said boom having a boom longitudinal axis and being pivotally attached to the base;

(5) a means for moving the boom, said means for moving the boom being adapted to move the boom between a position substantially parallel to the base longitudinal axis and a position substantially perpendicular to the base longitudinal axis;

(6) a pipe gripper, said pipe gripper being pivotally attached to the boom; wherein the base is adapted to be adjusted in all directions relative to the skid when the boom is in any position from substantially parallel to the base longitudinal axis to substantially perpendicular to the base longitudinal axis and the assembly is adapted to provide precise and infinite adjustment of the alignment of a drill pipe;

(b) engaging a pipe with the pipe gripper;

(c) moving the boom in a direction toward a pipe rotation mechanism;

(d) adjusting the base; and (e) releasing the pipe from the pipe gripper.

* * * * *